US012390084B2

(12) United States Patent
Battu et al.

(10) Patent No.: US 12,390,084 B2
(45) Date of Patent: Aug. 19, 2025

(54) SYSTEMS FOR MOUNTING RACKS IN DISHWASHING APPLIANCES

(71) Applicant: Haier US Appliance Solutions, Inc., Wilmington, DE (US)

(72) Inventors: Rajeswar Reddy Battu, Louisville, KY (US); Kyle Brewer, Louisville, KY (US); Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 231 days.

(21) Appl. No.: 18/354,276

(22) Filed: Jul. 18, 2023

(65) Prior Publication Data

US 2025/0025016 A1 Jan. 23, 2025

(51) Int. Cl.
*A47L 15/50* (2006.01)

(52) U.S. Cl.
CPC ..... *A47L 15/507* (2013.01)

(58) Field of Classification Search
None
See application file for complete search history.

(56) References Cited

U.S. PATENT DOCUMENTS

| | | | |
|---|---|---|---|
| 9,579,010 | B2 | 2/2017 | Shewmaker |
| 10,022,035 | B2 | 7/2018 | Dabade et al. |
| 10,813,530 | B2 | 10/2020 | Maddux |
| 11,229,344 | B2 | 1/2022 | Dabal |
| 2022/0167826 | A1 | 6/2022 | Singhal |

*Primary Examiner* — Rita P Adhlakha
(74) *Attorney, Agent, or Firm* — Dority & Manning, P.A.

(57) ABSTRACT

A dishwasher appliance includes a tub defining a wash chamber, and a rack assembly. The rack assembly includes a bracket positioned within the wash chamber of the tub. The bracket includes a roller extending therefrom, and a pair of posts mounted to the bracket. The pair of posts extend through an outer surface of the tub, and a brace is positioned opposite the bracket on the outer surface of the tub. The brace includes a snap projection configured to engage the pair of posts such that the snap projection hinders the pair of posts from retracting through the outer surface of the tub. A pair of fasteners extend through the brace into the pair of posts, where the pair of fasteners secure the brace to the pair of posts.

18 Claims, 7 Drawing Sheets

SYSTEMS FOR MOUNTING RACKS IN DISHWASHING APPLIANCES

FIELD OF THE INVENTION

The present subject matter relates generally to systems for mounting racks in dishwashing appliances, particularly relating to the mounting of third racks in dishwasher appliances.

BACKGROUND OF THE INVENTION

Dishwasher appliances generally include rack assemblies for positioning various articles for cleaning within a wash chamber. One or more devices, such as nozzles or spray assemblies, may be included at various locations relative to the rack assemblies for purposes of delivering fluids as part of the cleaning process. During the cleaning cycle, the rack assemblies can support and position the articles while also having openings that allow fluid to pass through to the articles. Factors such as the velocity of the fluid, orientation of the fluid spray or stream relative to the articles, the shape and density of the articles in the rack assemblies, and others can impact the effectiveness of the cleaning cycle.

One or more rack assemblies may be used in dishwasher appliances for user convenience. Multiple rack assemblies on multiple levels within dishwasher appliances may allow users to place articles of differing heights and sizes in optimal positions to allow for proper cleaning of the articles. Some dishwasher appliances may include one or more baskets which may also be provided for holding articles, particularly smaller or for more narrow articles, such as silverware. Additionally, the user may have the option of, e.g., placing articles, such as silverware, within a basket on a lower rack assembly or placing the silverware directly (without the basket) onto an upper rack assembly specially configured for the receipt of such articles.

The positioning of articles within a dishwasher appliance can affect the fluid dynamics to which the articles are exposed during the cleaning process. For example, articles placed in a lower rack assembly may be subjected to different spray assemblies with different spray patterns, velocities, and spray duration than articles placed in a higher rack assembly. As dishwasher appliances have begun including more racks, space and positioning of dishwashing components, such as rack-mounting systems, inside of the dishwasher is important to ensure proper washing.

BRIEF DESCRIPTION OF THE INVENTION

Aspects and advantages of the invention will be set forth in part in the following description, or may be apparent from the description, or may be learned through practice of the invention.

In one example embodiment, a dishwasher appliance defines a vertical direction, a lateral direction, and a transverse direction. The vertical, lateral, and transverse directions are mutually perpendicular. The dishwasher appliance includes a tub defining a wash chamber, a wash conduit in the wash chamber, a first rack assembly slidably positioned within the wash chamber, and a first spray assembly positioned in the wash chamber, configured to direct wash fluids at the first rack assembly. The dishwasher appliance also includes a second rack assembly slidably positioned in the wash chamber above the first rack assembly, and a second spray assembly positioned in the wash chamber, configured to direct wash fluids at the second rack assembly. The dishwasher appliance further includes a third rack assembly slidably positioned in the wash chamber above the second rack assembly. The third rack assembly includes a bracket positioned within the wash chamber of the tub. The bracket includes a roller extending therefrom, and a pair of posts mounted to the bracket. The pair of posts extend through an outer surface of the tub, and a brace is positioned opposite the bracket on the outer surface of the tub. The brace includes a snap projection configured to engage the pair of posts such that the snap projection hinders the pair of posts from retracting through the outer surface of the tub. A pair of fasteners extend through the brace into the pair of posts, where the pair of fasteners secure the brace to the pair of posts.

In another example embodiment, a dishwasher appliance includes a tub defining a wash chamber, and a rack assembly. The rack assembly includes a bracket positioned within the wash chamber of the tub. The bracket includes a roller extending therefrom, and a pair of posts mounted to the bracket. The pair of posts extend through an outer surface of the tub, and a brace is positioned opposite the bracket on the outer surface of the tub. The brace includes a snap projection configured to engage the pair of posts such that the snap projection hinders the pair of posts from retracting through the outer surface of the tub. A pair of fasteners extend through the brace into the pair of posts, where the pair of fasteners secure the brace to the pair of posts.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
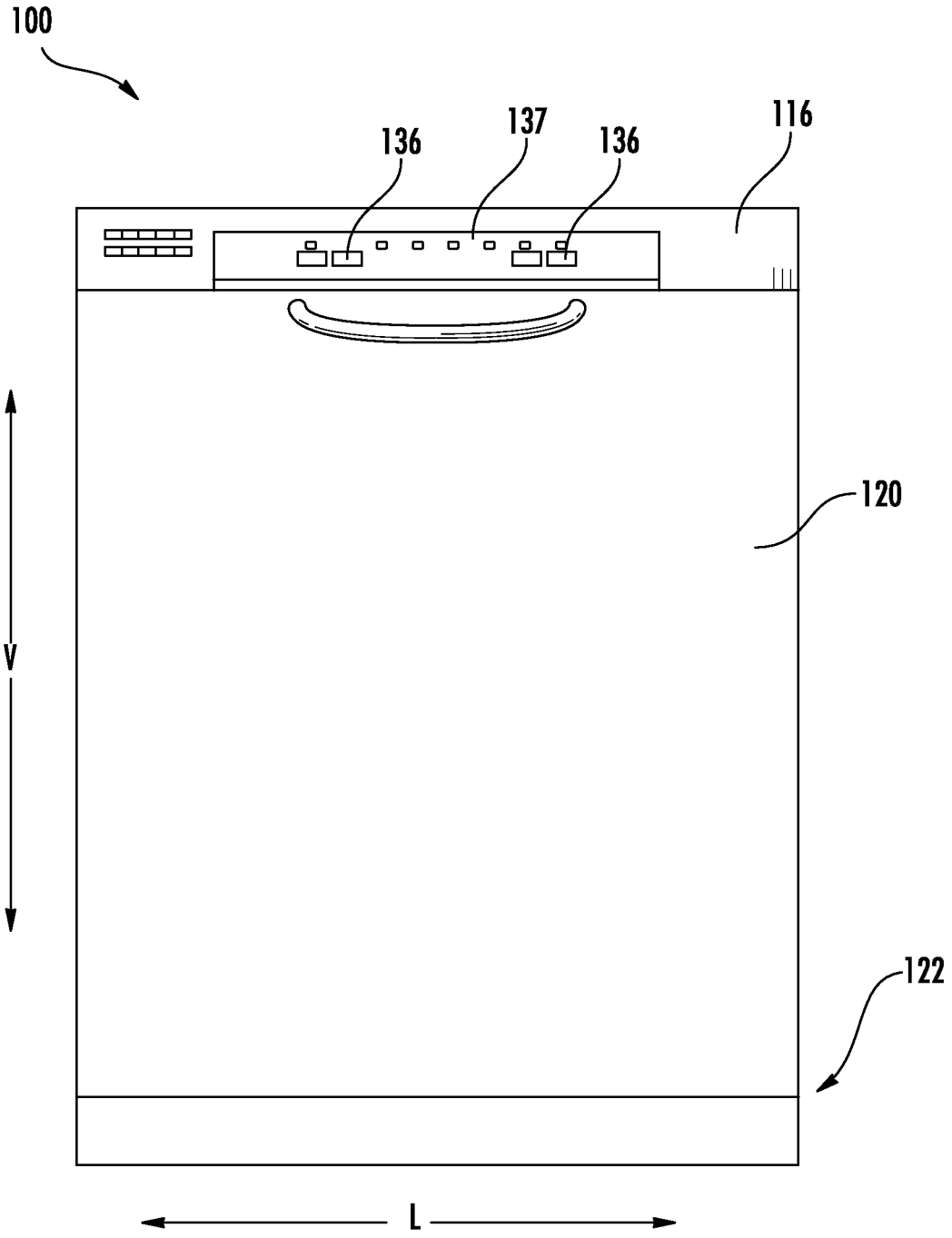
FIG. 1 provides a front, elevation view of a dishwasher appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
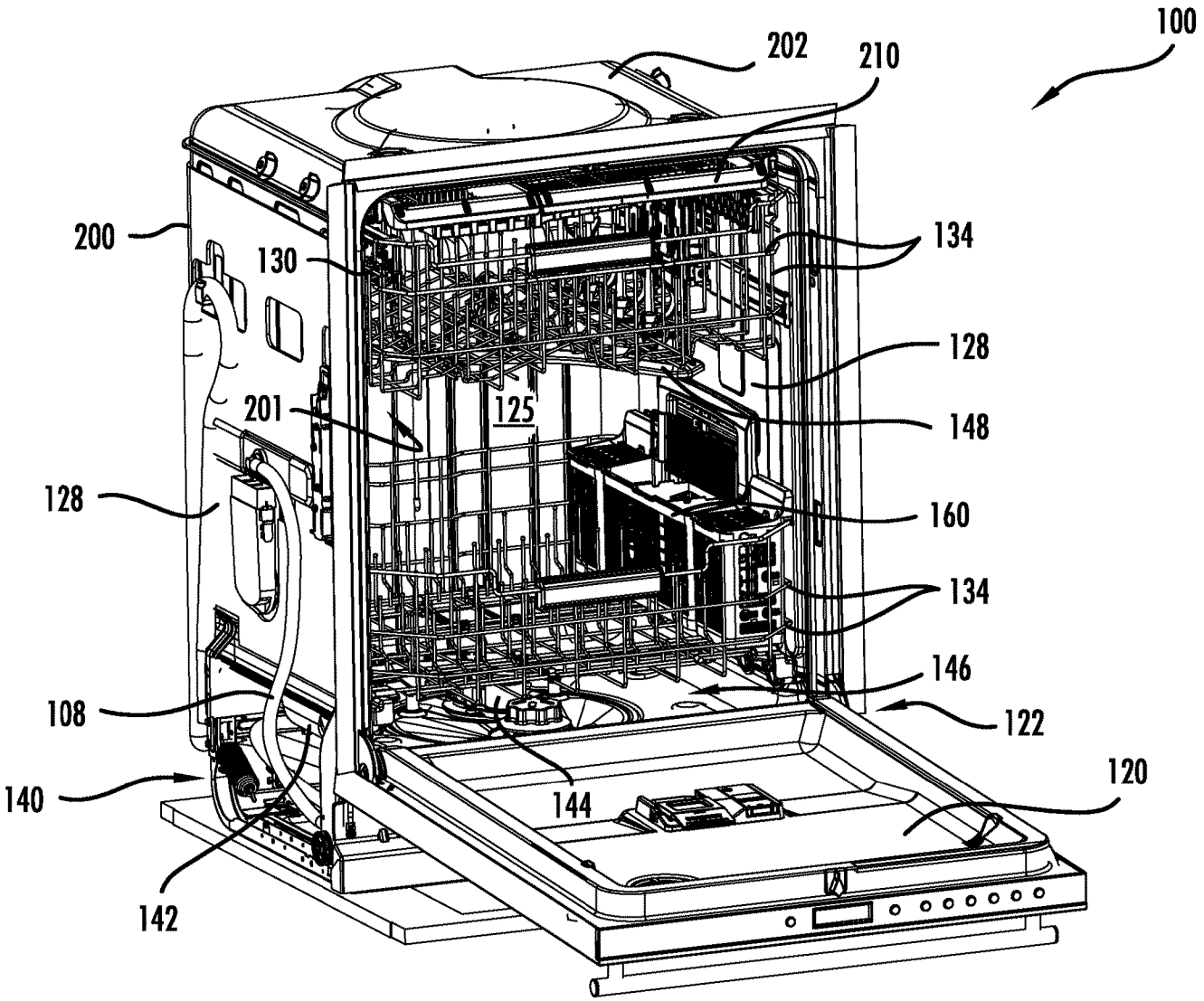
FIG. 2 provides a perspective view of the example dishwasher appliance of FIG. 1 with a door of the example dishwasher appliance shown in an open position to reveal a wash chamber of the example dishwasher appliance.

FIG. 1 provides a front, elevation view of a dishwasher appliance 100 according to an example embodiment of the present subject matter. FIG. 2 provides a perspective view of dishwasher appliance 100 with a door 120 of dishwasher appliance 100 shown in an open position to reveal a wash chamber or compartment 201 of dishwasher appliance 100. Dishwasher appliance 100 defines a vertical direction V, a lateral direction L, and a transverse direction T. Vertical direction V, lateral direction L, and transverse direction T are mutually perpendicular and form an orthogonal direction system.

Dishwasher appliance 100 includes a tub 200 that defines wash chamber 201. Tub 200 has a pair of side walls 128, a back wall 125, and a top wall 202 that assist with defining wash chamber 201. Side walls 128 are spaced apart from each other, e.g., along the lateral direction L. Back wall 125 and top wall 202 extend between and connect side walls 128, e.g., along the lateral direction L. Tub 200 also includes door 120 hinged at its bottom 122 for movement between a normally closed configuration (shown in FIG. 1) in which wash chamber 201 is sealed shut, e.g., for washing operation, and an open configuration (shown in FIGS. 2 and 3) for loading and unloading of articles from dishwasher appliance 100.

Turning to FIG. 2, tub side walls 128 accommodate middle and lower rack assemblies 130 and 132. Each of the middle and lower racks assemblies 130 and 132 is fabricated from lattice structures that include a plurality of wires or elongated members 134. Dishwasher appliance 100 also includes an upper rack assembly 210 positioned above middle and lower racks assemblies 130 and 132, e.g., along the vertical direction V, at a top portion of wash chamber 201. Each rack assembly 130, 132 and 210 is adapted for movement between an extended loading position (not shown) in which the rack assembly is substantially positioned outside the wash chamber 201, and a retracted position (shown in FIGS. 1 and 2) in which the rack assembly is located inside the wash chamber 201.

Dishwasher appliance 100 includes a lower spray assembly 144 that is mounted within a lower region 146 of the wash chamber 201 and above a tub sump portion 142 so as to be in relatively close proximity to the lower rack assembly 132. A mid-level spray assembly 148 is located in an upper region of the wash chamber 201 and may be located in close proximity to middle rack assembly 130. Additionally, an upper spray assembly (not shown) may be located above the upper rack assembly 210 and mounted to top wall 202 of tub 200.

The lower and mid-level spray assemblies 144 and 148 and the upper spray assembly are fed by a pump (not shown) for circulating water and wash fluid (e.g., detergent, water, and/or rinse aid) in the tub 200. The pump is located in a machinery compartment 140 located below the bottom sump portion 142 of the tub 200, as generally recognized in the art. A conduit or circulation piping 108 directs water and/or wash fluid from the pump to lower spray assembly 144 and mid-level spray assembly 148.

Each spray assembly includes an arrangement of discharge ports or orifices for directing wash fluid onto dishes or other articles located in the middle and lower rack assemblies 130, 132, silverware basket 160 and upper rack assembly 210. Lower spray assembly 144 is rotatably mounted in wash chamber 201. Accordingly, the arrangement of the discharge ports on lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated example embodiment, controller 137 is located within a control panel 116 of door 120. In alternative example embodiments, controller 116 may be positioned beneath tub 200 or at any other suitable location on dishwasher appliance 100. Typically, controller 137 includes a user interface panel 136 through which a user may select various operational features and modes and monitor progress of the dishwasher appliance 100. In one example embodiment, user interface 136 represents a general purpose I/O ("GPIO") device or functional block. In another example embodiment, user interface 136 includes input components, such as one or more of a variety of electrical, mechanical or electro-mechanical input devices including rotary dials, push buttons, and touch pads. User interface 136 may include a display component, such as a digital or analog display device designed to provide operational feedback to a user.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations or spray assembly arrangements.

Figure 3:
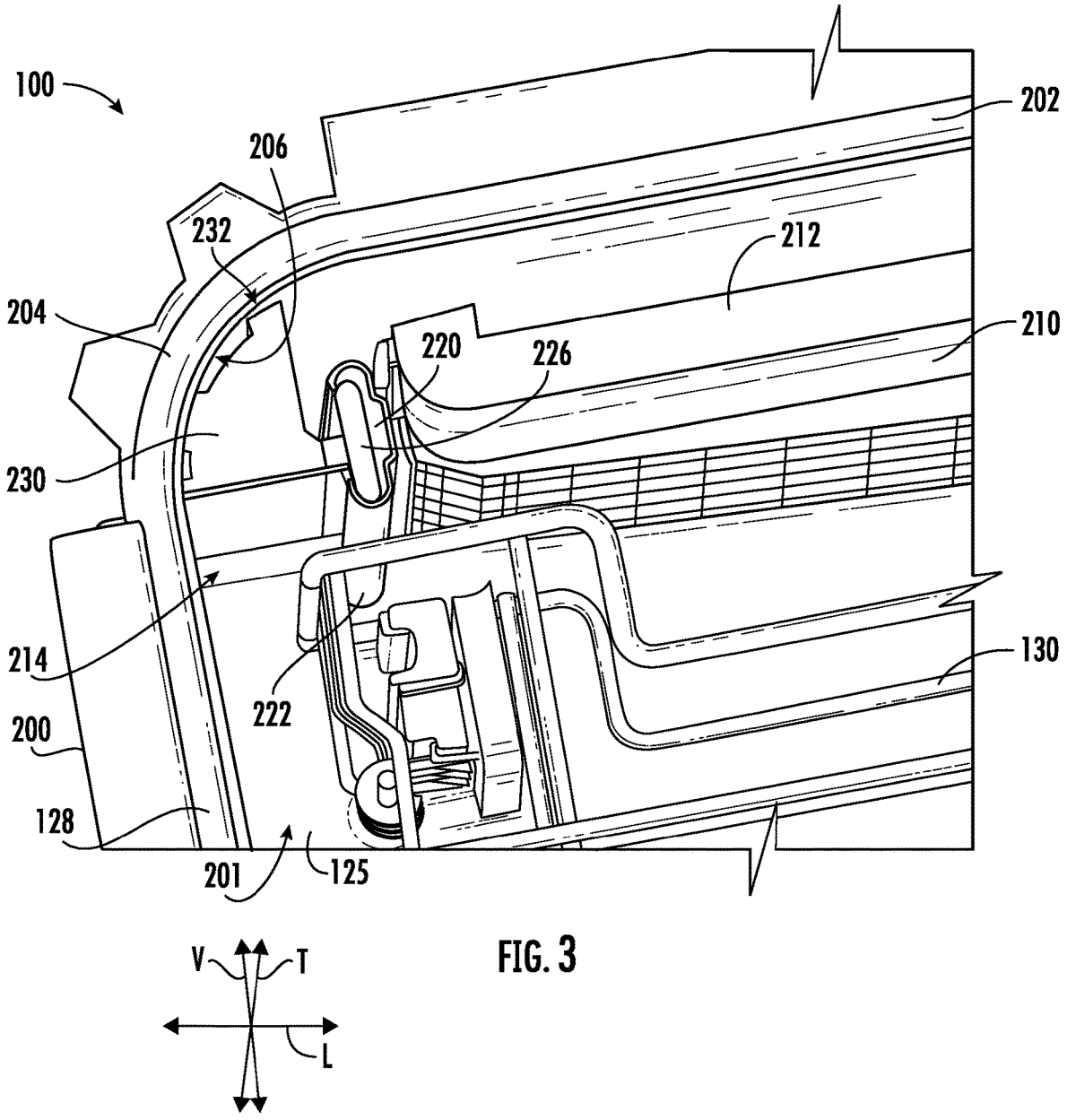
FIG. 3 provides a partial, front perspective view of a tub and a rack assembly of the example dishwasher appliance of FIG. 1.
Figure 4:
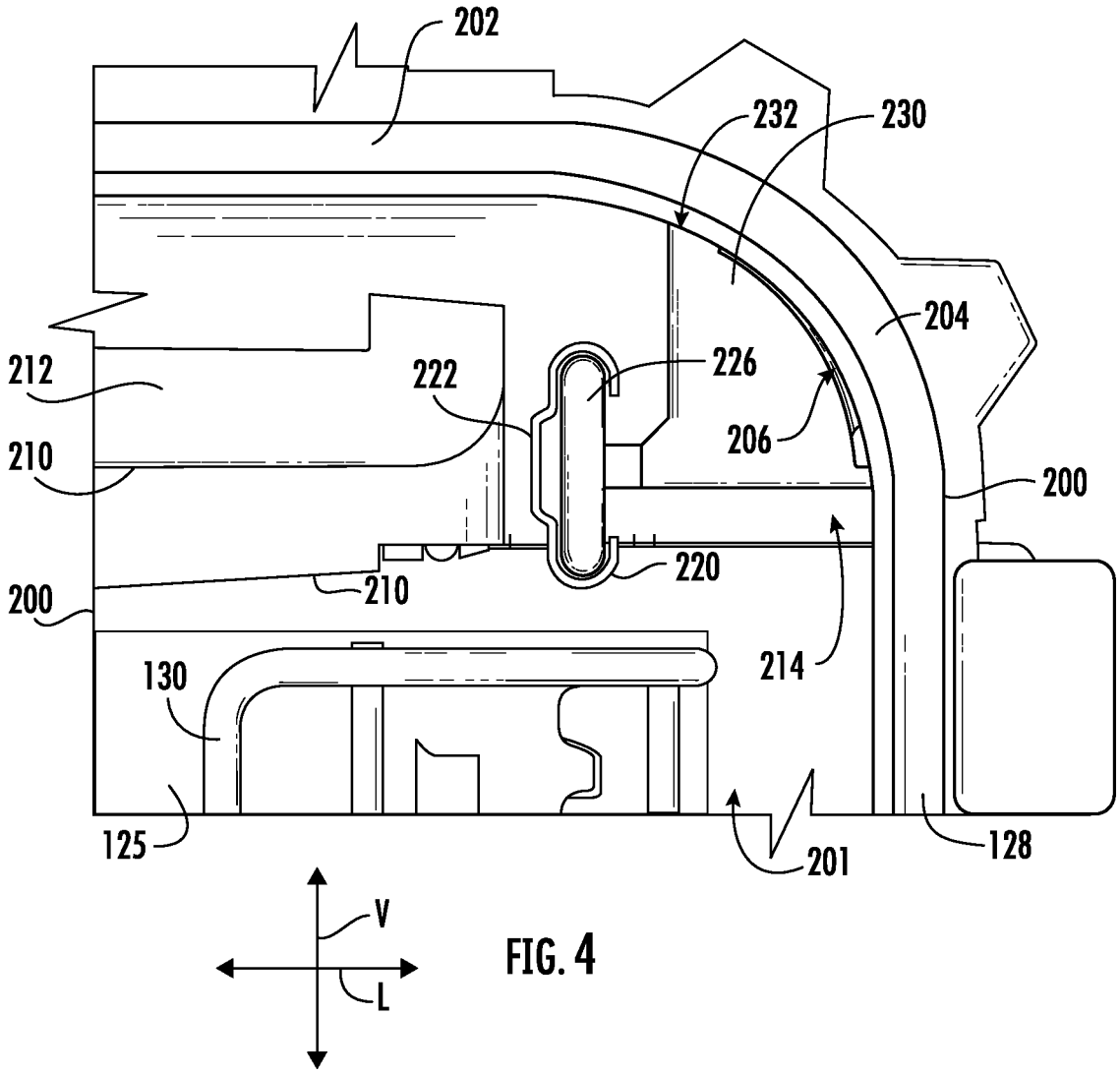
FIG. 4 provides a partial, front elevation view of the tub and rack assembly of the example dishwasher appliance of FIG. 1.

FIG. 3 provides a partial, front perspective view of tub 200 and upper rack assembly 210 of dishwasher appliance 100. FIG. 4 provides a partial, front elevation view of tub 200 and rack assembly 210 of dishwasher appliance 100. As discussed in greater detail below, rack assembly 210 includes features for assisting with mounting rack assembly 210 to tub 200 within wash chamber 201 of tub 200. In addition, it should be understood that, while described in greater detail below in the context of dishwasher appliance 100, tub 200 and/or rack assembly 210 may be used in any other suitable dishwasher appliance, in alternative example embodiments.

As may be seen in FIGS. 3 and 4, tub 200 defines wash chamber 201 and includes a top wall 202 and transition portions 204. Transition portions 204 correspond to portions of tub 200 that extend between top wall 202 and other portions of tub 200, such as side walls 128 and/or back wall 125, e.g., along the vertical direction V. Transition portions 204 include curved inner surfaces 206. In certain example embodiments, tub 200 is constructed of or with a molded material, such as plastic, or a stamped material, such as stainless steel. Thus, top wall 202 and transition portions 204 may be integrally formed of a single piece of molded plastic or stamped metal.

Rack assembly 210 includes silverware baskets 212 and mounting assembly 214. Silverware baskets 212 are configured for receiving and supporting silverware therein during operation of an associated dishwasher appliance. Mounting assembly 214 assists with mounting silverware baskets 212 to tub 200. Thus, mounting assembly 214 can assist with supporting silverware baskets 212 within wash chamber 201 of tub 200. As may be seen in FIGS. 3 and 4, mounting assembly 214 includes a slide rail 220 and at least one bracket 230. Brackets 230 are mounted to tub 200 and are positioned within wash chamber 201 of tub 200. Slide rail 220 is also positioned within wash chamber 201 of tub 200. In particular, slide rail 220 is slidably mounted to brackets 230 within wash chamber 201 of tub 200, as discussed in greater detail below.

As discussed above, tub 200 defines curved inner surface 206. As may be seen in FIGS. 3 and 4, brackets 230 may be positioned in wash chamber 201 at or on curved inner surface 206 of tub 200. In particular, brackets 230 define a curved outer surface 232. Curved outer surface 232 of brackets 230 are complementary to curved inner surface 206 of tub 200. In particular, a shape or profile of curved outer surface 232 of brackets 230 can substantially match or fit curved inner surface 206 of tub 200, e.g., in a plane that is perpendicular to the transverse direction T. Curved outer surface 232 of brackets 230 may be positioned on or at curved inner surface 206 of tub 200.

Slide rail 220 is positioned within wash chamber 201 of tub 200 and is mounted or positioned on a roller 226 of brackets 230. Roller 226 is moveable or slidable within slide rail 220, e.g., along the transverse direction T. However, roller 226 may hinder or prevent movement of slide rail 220 along other directions, such as the vertical direction V and/or the lateral direction L. Thus, roller 226 may permit movement of slide rail 220 along only the transverse direction T when roller 226 of brackets 230 is received within slide rail 220. Rack assembly 210 also includes a seal or gasket (not shown). The gasket is positioned at or on curved outer surface 232 of bracket 230. The gasket assists with hindering or preventing leaks or liquid flow out of wash chamber 201 of tub 200.

As may be seen in FIGS. 3 and 4, slide rail 220 may include a C-shaped channel 222 positioned on rollers 226. Thus, roller 226 may be received within C-shaped channel 222. Rack assembly 210 also includes a frame 228 (e.g., formed of bent metal wire). Frame 228 supports silverware baskets 212, e.g., and is positioned below silverware baskets 212 along the vertical direction V. Thus, silverware baskets 212 may rest on and/or be mounted to frame 228.

Figure 5:
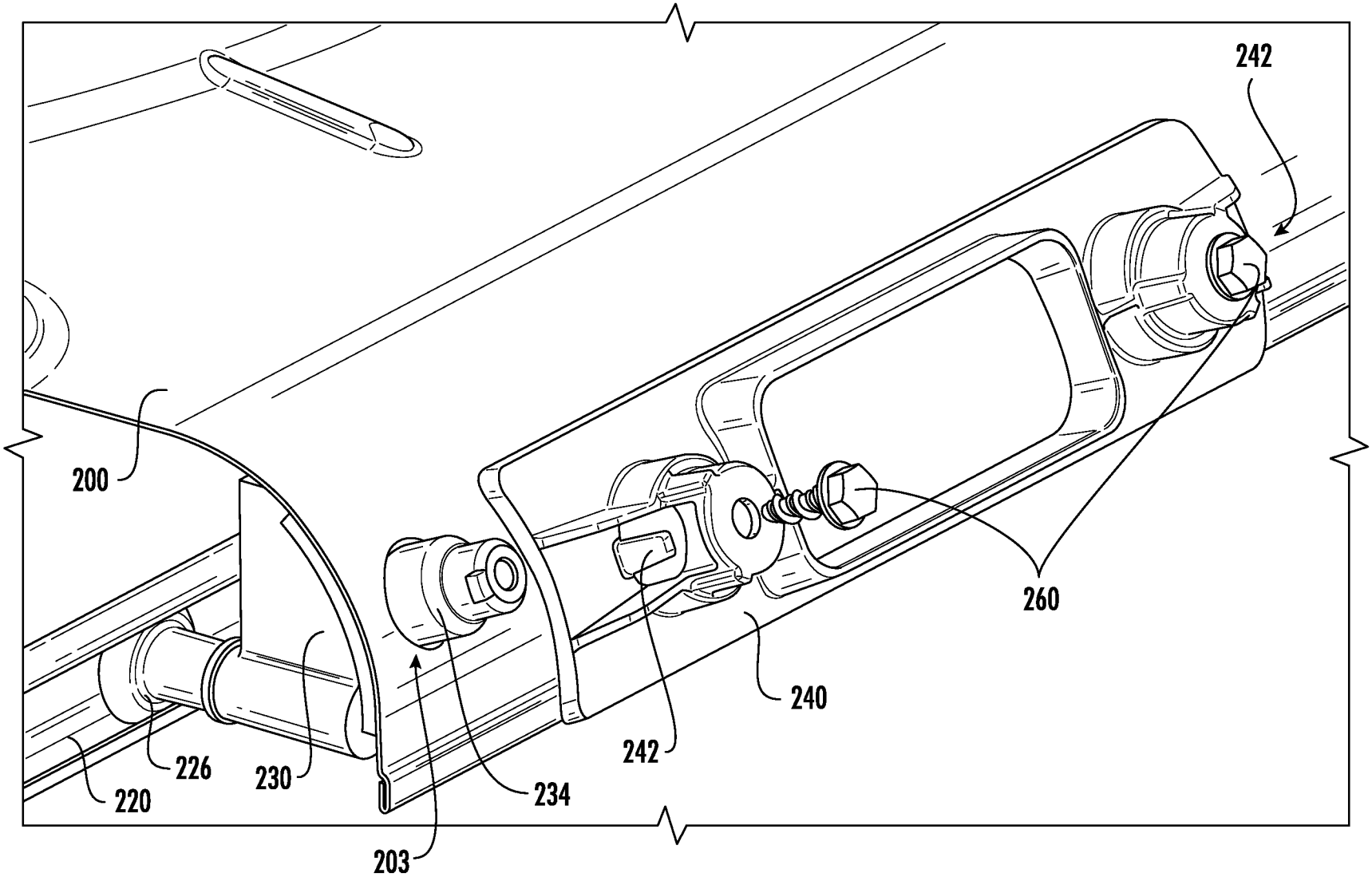
FIG. 5 provides an exploded perspective view of a brace 240 of the rack assembly of the example dishwasher appliance of FIG. 1.
Figure 6:
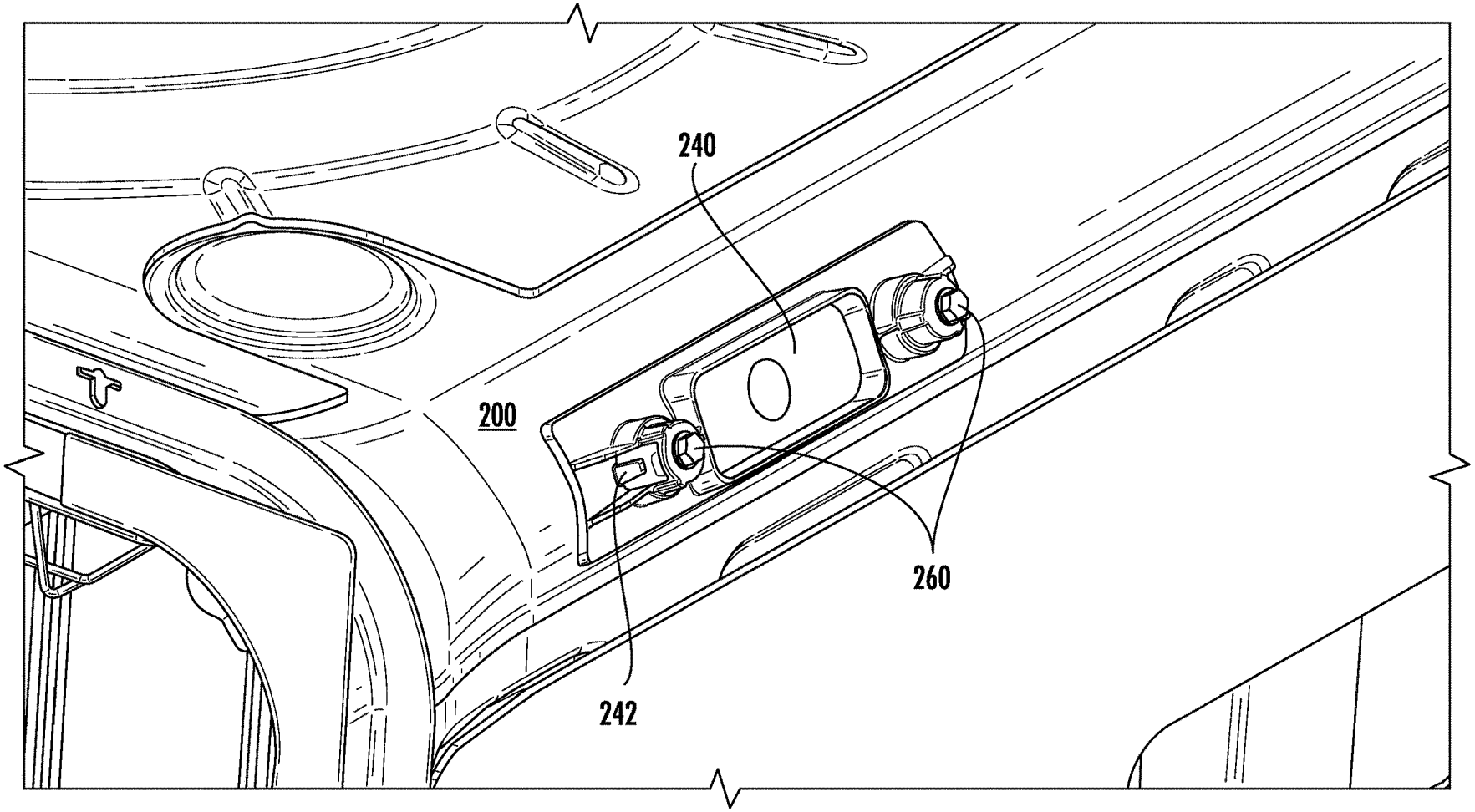
FIG. 6 provides an assembled perspective view of the brace of FIG. 5.

FIG. 5 provides an exploded perspective view of a brace 240 of rack assembly 210. FIG. 6 provides an assembled perspective view of brace 240 of rack assembly 210. Brackets 230 also include various features for assisting with mounting brackets 230 to tub 200, e.g., easily and/or quickly. In particular, a pair of projection or post 234 is mounted to each bracket 230. As an example, posts 234 may be integrally mounted to brackets 230 such that posts 234 and brackets 230 are constructed from a single, continuous piece of material, such as molded plastic. Posts 234 extend from brackets 230 through the tub 200. A brace 240 is snapped onto posts 234. e.g., outside of wash chamber 201 of tub 200. Thus, brace 240 is not disposed within wash chamber 201 of tub 200. Brace 240 may extend between the pair of posts 234 along the outer surface of the tub. A snap projection 242 may engage with post 234 within brace 240 preventing or hindering posts 234 from moving back though holes 203 into wash chamber 201 of tub 200. In some example embodiments, brace 240 may include a pair of snap projections 242 configured to engage the pair of posts 234 such that each of the snap projections 242 hinders the pair of posts 234 from retracting through the curved inner surface 206 of tub 200. Further, fasteners 260 also extend into post 234, e.g., outside of wash chamber 201 of tub 200. Thus, fasteners 260 are also not disposed within wash chamber 201 of tub 200. Fasteners 260 may be threaded or mounted onto post 234. In particular, screw threads of fasteners 260 may engage or mesh with posts 234.

Mounting of rack assembly 210 to tub 200 is discussed in greater detail below with reference to FIGS. 3 and 4. To mount rack assembly 210 to tub 200, an assembler can mount slide rail 220 to brackets 230, e.g., such that slide rail 220 is received on rollers 226. The assembler can then position brackets 230 (with slide rail 220 mounted thereto) within wash chamber 201 of tub 200. In addition, the assembler can direct or insert posts 234 through holes defined by tub 200, e.g., until curved outer surfaces 232 of brackets 230 are disposed on or at curved inner surface 206 of tub 200 and posts 234 are positioned or disposed outside of wash chamber 201 of tub 200. With posts 234 so positioned, the assembler can hold or support brackets 230 and slide rail 220 within wash chamber 201 of tub 200 and snap brace 240 onto posts 234. In particular, the assembler can snap the snap projection 242 onto the post 234. With brace 240 so positioned, brace 240 supports brackets 230 and slide rail 220 within wash chamber 201 of tub 200 by preventing or hindering posts 234 from moving back though holes 203 into wash chamber 201 of tub 200. Thus, the assembler can let go of and stop supporting brackets 230 and slide rail 220 within wash chamber 201 of tub 200 due to brace 240 supporting such components.

With brace 240 supporting brackets 230 and slide rail 220 within wash chamber 201 of tub 200, the assembler fixes a pair of fasteners 260 to the pair of posts 234 through brace 240. The pair of fasteners 260 may include at least one of screws or bolts. In particular, the assembler can rotate or turn fasteners 260 with a tool or drill in order to thread fasteners 260 into posts 234 with the drill. The assembler can tighten fasteners 260 against brace 240 and/or fix fasteners 260 to posts 234 such that brackets 230 are drawn towards tub 200 within wash chamber 201 of tub 200. By drawing brackets 230 towards tub 200, the gasket is compressed between tub 200 and brackets 230, e.g., between curved outer surfaces 232 of brackets 230 and curved inner surface 206 of tub 200. By extending between tub 200 and brackets 230, the gasket can assist with limiting or preventing leaks or liquid flow through or out of the holes in tub 200.

Figure 7:
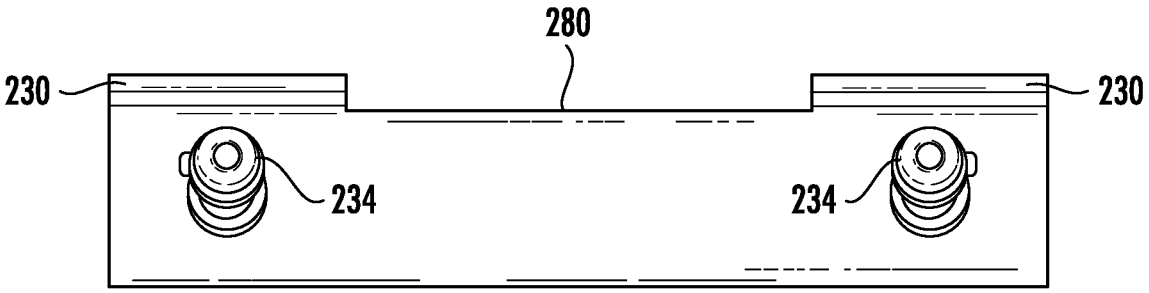
FIG. 7 provides a perspective view of an example bracket of the rack assembly of FIG. 5.

As may be seen in FIG. 7, a connecting rail 280 may extend between and connect brackets 230 such that brackets 230 are coupled together with connecting rail 280. Connecting rail 280 may be integrally formed with brackets 230. Thus, brackets 230 and connecting rail 280 may be constructed from a single, continuous piece of material, such as molded plastic. As another example, brackets 230, posts 234 and connecting rail 280 may be constructed from a single, continuous piece of material, such as molded plastic.

Mounting assembly 214 may advantageously assist with mounting slide rail 220 to tub 200 within wash chamber 201 of tub 200, e.g., without welding and/or tox. Mounting assembly 214 may also permit a single installer or assembler to mount slide rail 220 to tub 200 within wash chamber 201 of tub 200. Slide rail 220 may be substantially level when mounted to tub 200.

As may be seen from the above, a single piece brace with snap projections eliminates the need for individual components of traditional sleeve tub mount systems. The operator traditionally would install two sleeve tub mounts and two brace tub mounts to the exterior of the dishwasher. The assembler would then be able to use two unique screws for the final install. Additionally, this would be repeated for the opposite side tub mount. The single piece brace advantageously reduces the number of parts and decreases the complexity of assembly compared to the traditional methods.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the vertical, lateral, and transverse directions being mutually perpendicular, the dishwasher appliance comprising:

a tub defining a wash chamber;

a wash conduit in the wash chamber;

a first rack assembly slidably positioned within the wash chamber;

a first spray assembly positioned in the wash chamber and configured to direct wash fluids at the first rack assembly;

a second rack assembly slidably positioned in the wash chamber above the first rack assembly;

a second spray assembly positioned in the wash chamber and configured to direct wash fluids at the second rack assembly;

a third rack assembly slidably positioned in the wash chamber above the second rack assembly, the third rack assembly comprising;

a bracket positioned within the wash chamber of the tub, the bracket comprising a roller extending therefrom;

a pair of posts mounted to the bracket, the pair of posts extending through an outer surface of the tub;

a brace positioned opposite the bracket on the outer surface of the tub, the brace comprising a snap projection configured to engage the pair of posts such that the snap projection hinders the pair of posts from retracting through the outer surface of the tub; and a pair of fasteners extending through the brace into the pair of posts, the pair of fasteners securing the brace to the pair of posts.

2. The dishwasher appliance of claim 1, wherein a top portion of the tub defines a curved inner surface, the bracket defining a curved outer surface that is complementary to the curved inner surface of the tub, the bracket positioned within the wash chamber such that the curved outer surface of the bracket is positioned at the curved inner surface of the tub.

3. The dishwasher appliance of claim 1, further comprising a slide rail positioned within the wash chamber and mounted on the roller of the bracket.

4. The dishwasher appliance of claim 3, wherein the slide rail comprises a C-shaped channel received on the roller of the bracket such that the C-shaped channel is slidable on the roller of the bracket.

5. The dishwasher appliance of claim 1, wherein the bracket and the post are integrally formed of a continuous piece of plastic.

6. The dishwasher appliance of claim 1, wherein the brace extends between the pair of posts along the outer surface of the tub.

7. The dishwasher appliance of claim 6, wherein the brace comprises a pair of snap projections configured to engage the pair of posts such that each of the snap projections hinders the pair of posts from retracting through the outer surface of the tub.

8. The dishwasher appliance of claim 1, wherein the pair of fasteners comprises at least one of screws or bolts.

9. The dishwasher appliance of claim 1, wherein the pair of fasteners engaging with the pair of posts restricts movement of the bracket inside the wash chamber.

10. A dishwasher appliance comprising:

a tub defining a wash chamber; and a rack assembly, comprising;

a bracket positioned within the wash chamber of the tub, the bracket comprising a roller extending therefrom;

a pair of posts mounted to the bracket, the pair of posts extending through an outer surface of the tub;

a brace positioned opposite the bracket on the outer surface of the tub, the brace comprising a snap projection configured to engage the pair of posts such that the snap projection hinders the pair of posts from retracting through the outer surface of the tub; and a pair of fasteners extending through the brace into the pair of posts, the pair of fasteners securing the brace to the pair of posts.

11. The dishwasher appliance of claim 10, wherein a top portion of the tub defines a curved inner surface, the bracket defining a curved outer surface that is complementary to the curved inner surface of the tub, the bracket positioned within the wash chamber such that the curved outer surface of the bracket is positioned at the curved inner surface of the tub.

12. The dishwasher appliance of claim 10, further comprising a slide rail positioned within the wash chamber and mounted on the roller of the bracket.

13. The dishwasher appliance of claim 12, wherein the slide rail comprises a C-shaped channel received on the roller of the bracket such that the C-shaped channel is slidable on the roller of the bracket.

14. The dishwasher appliance of claim 10, wherein the bracket and the post are integrally formed of a continuous piece of plastic.

15. The dishwasher appliance of claim 10, wherein the brace extends between the pair of posts along the outer surface of the tub.

16. The dishwasher appliance of claim 15, wherein the brace comprises a pair of snap projections configured to engage the pair of posts such that each of the snap projections hinders the pair of posts from retracting through the outer surface of the tub.

17. The dishwasher appliance of claim 10, wherein the pair of fasteners comprises at least one of screws or bolts.

18. The dishwasher appliance of claim 10, wherein the pair of fasteners engaging with the pair of posts restricts movement of the bracket inside the wash chamber.

* * * * *